US006997771B1

(12) United States Patent
Lucier

(10) Patent No.: US 6,997,771 B1
(45) Date of Patent: Feb. 14, 2006

(54) SELF-SUPPORTING BUILDING CARDS

(75) Inventor: Cary Lucier, Windsor (CA)

(73) Assignee: Stak-Its Toy Company Inc., Ontario (CA)

( * ) Notice: Subject to any disclaimer, the term of this patent is extended or adjusted under 35 U.S.C. 154(b) by 160 days.

(21) Appl. No.: 09/702,825

(22) Filed: Nov. 1, 2000

(30) Foreign Application Priority Data

Nov. 2, 1999 (CA) ..... 2288383

(51) Int. Cl.
*A63H 33/08* (2006.01)

(52) U.S. Cl. ..... 446/108; 446/128

(58) Field of Classification Search ..... 446/69, 446/85, 108, 109, 112, 115, 116, 117, 125, 446/128
See application file for complete search history.

(56) References Cited

U.S. PATENT DOCUMENTS 3,604,145 A 9/1971 Zimmerman ..... 446/108
3,728,201 A 4/1973 Stroehmer
3,895,456 A 7/1975 Fabre ..... 446/109
3,999,350 A * 12/1976 MacKenzie ..... 446/124
4,685,892 A * 8/1987 Gould et al. ..... 446/109
5,197,596 A * 3/1993 Garganese ..... 206/6.1
5,788,233 A * 8/1998 Wolfe ..... 273/156
6,153,311 A * 11/2000 Springer et al. ..... 428/542.2
6,643,961 B1 * 11/2003 Hluchan ..... 40/492
2002/0078653 A1 * 6/2002 Jean ..... 52/578
2002/0168916 A1 * 11/2002 Axelrad ..... 446/109

FOREIGN PATENT DOCUMENTS

GB 2252056 7/1992

* cited by examiner

*Primary Examiner*—Jacob K. Ackun, Jr.
(74) *Attorney, Agent, or Firm*—Jacobson Holman PLLC

(57) ABSTRACT

A set of elements used for building easily disassembled structures includes a plurality of building cards. At least one surface of each card is provided with protrusions extending normally therefrom. When an edge of a first card is in abutting contact with one or more protrusions of a second card, the one or more protrusions prevent the first card from sliding beyond a point or locus defined by the one or more protrusions thereby permitting the first card to be stably leaned against a third card, and so on, to create supported structures constructed from a plurality of the building cards.

2 Claims, 3 Drawing Sheets

SELF-SUPPORTING BUILDING CARDS

FIELD OF THE INVENTION

This invention relates generally to a set of elements such as cards and a related method for building toy structures. In particular, each element or card has raised protrusions which may be used to support other cards enabling the cards to lean one against another to build simple or complex structures.

Various building elements and methods are known in the prior art. These elements and methods have been provided to permit children to express and enhance creative building desires. From the stacking of simple blocks to the attaching of complex connecting devices, a large segment of the toy industry is dedicated to the manifestation of a child's ideas into physical forms. These types of toys appeal to children of all ages from toddler to adolescent.

DESCRIPTION OF THE RELATED ART

There have been several approaches taken previously in this regard. An example of prior art is U.S. Pat. No. 3,895,456 granted to Fabre on Jul. 22, 1975 which teaches "constructional" elements shaped as sheets or tridimensional bodies having protruding peg-and-socket members to "interengage" each other. Elements may be used to build compositions by nesting a peg member within a socket member of another element or the same element.

Although the elements described by Fabre may be used to build a variety of structures, the peg-and-socket members used to "interengage" elements imply a level of durability in the bonds between elements and also a level of durability in the assembled structures. This may result in a corresponding amount of time and effort required to disassemble any structures created. Accordingly, there may be some inconvenience in disassembling a creation when it is no longer desired or when the elements used to build it are needed to create a new structure. Furthermore, the relative ease with which stable structures may be created by nesting peg members within socket members may eliminate an element of challenge and reduce the degree of dexterity required to create structures having a looser or less durable construction mechanism. Fabre's apparent requirement that each member comprise a depression which is concave on one side of the element (corresponding to a socket member) and convex on the other side of the element (corresponding to a peg member) so as to be capable of "shape-conforming locking relationship with any other depression" undesirably constrains the possible variations in the arrangement of the protrusions (peg members) of the elements and may limit the possible methods of manufacturing such a product.

Another more familiar example of prior art can be found in ordinary playing cards which can be used to build a variety of structures. A conventional deck of cards consists of a set of flat rectangular cards which may be used to build structures by leaning one card against another to create "houses of cards". The structures which can be assembled by ordinary playing cards are limited since playing cards tend to be slippery and they do not have a proper surface for other cards to support themselves against when they are leaned one against another. If a leaning card begins to slide, there is nothing preventing it from falling over. Without proper support, these card houses will almost always collapse before completion. This lack of support inherent in conventional playing cards limits the creative options available to a builder.

Another problem arises when playing cards are laid flat on top of other cards as ceiling members. When flat, these cards are extremely difficult to build upon without slippage, making multiple level structures very difficult to create. Any slippage in a multiple level structure will usually cause the entire structure to collapse. Building on a hard flat surface such as a wooden floor or a table top will create the same slippage problem as encountered in the additional levels of a card house. The constant threat of slippage means that it takes great effort and manual dexterity on behalf of the builder to complete a card house. Even the slightest mistake is enough to cause a structure to come crashing down. This method of building is very difficult for most people because of the level of skill and patience that is required to succeed. Most card house builders end up quitting out of sheer frustration.

A further drawback of the use of conventional playing cards is their uniform rectangular shape which limits the possible building configurations when compared to a set of cards which includes a variety of different shapes.

SUMMARY OF THE INVENTION

Accordingly, it is an object of the present invention to overcome the above difficulties and provide a set of cards which permit the construction of a large variety of structures of reasonable stability and complexity and stimulate creativity in the builder while presenting a level of challenge to the builder. A further object is to provide a set of cards which permit the construction of structures which are easily disassembled.

According to a first aspect of the present invention, there is provided a set of elements for building easily disassembled structures, each element comprising: a flat structure having front and rear surfaces and at least one edge defining a perimeter common to the two surfaces; and a plurality of protrusions on at least one of the surfaces, each protrusion having a body portion extending away from the element; wherein the body portions of one or more protrusions, when in abutting contact with an edge of another element, anchor the other element by preventing the edge of the other element from sliding beyond the point or locus defined by the one or more protrusions; whereby structures may be assembled from a plurality of elements by suitable operations including leaning a first element against a second and anchoring the first element against sliding by placing an edge of the first element in abutting contact with at least one protrusion of a third element or anchoring the edge by placing it on a suitable non-slip surface; and balancing an element on top of one or more other elements.

According to a second aspect of the present invention, there is provided a method of building an easily disassembled structure using elements as defined above comprising the steps of: (i) arranging one or more initial elements to form an initial structure; and (ii) developing the structure by adding one or more additional elements thereto by repeatedly performing as desired any one or more of the following operations: a) identifying a formation of the structure capable of supporting an added element when a surface of the added element is balanced on the formation; and placing the added element on the formation so that the added element is stably supported thereby; b) identifying a formation of the structure capable of supporting a leaning added element when an edge of the added element is anchored by a suitable non-slip surface or is anchored by at least one first portion of the formation preventing undesirable sliding of the added element, and at least one second portion of the formation supports the leaning added element in a balanced arrangement; and placing the added element on the formation so that the leaning added element is stably supported thereby; c) identifying a formation of the structure capable of supporting an added substructure, the substructure comprising a plurality of elements whereby the added substructure is supported by balancing, in accordance with the principle of operation (a) or leaning, in accordance with the principle of operation (b) or a combination of both; and placing the added substructure to the formation so that the resulting formation is stable.

BRIEF DESCRIPTION OF THE DRAWINGS

Embodiments of the present invention will be further described by way of example with reference to the accompanying drawings in which.

DETAILED DESCRIPTION OF THE PREFERRED EMBODIMENTS

Figure 1:
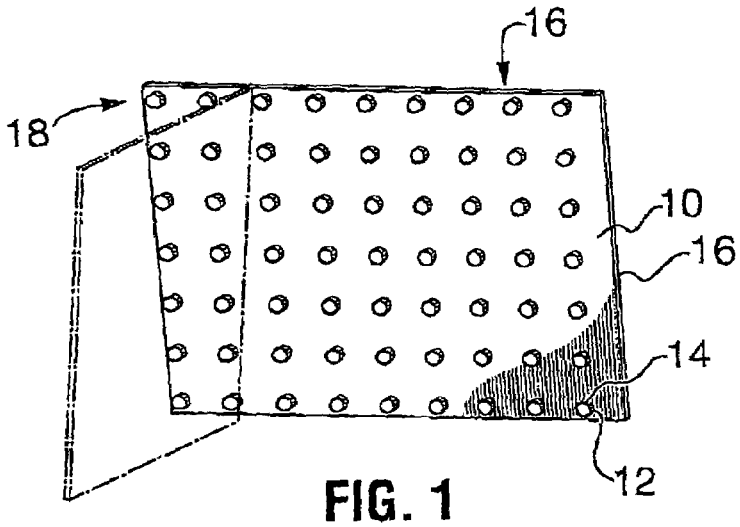
FIG. 1 shows a front view of a building card in accordance with a first embodiment of the present invention.

FIG. 1 shows a preferred embodiment of the present invention in which building cards each comprise a rectangular card 10 of uniform thickness made of a stiff material. For the purposes of this preferred embodiment the expression "card" refers to a rectangular card unless otherwise specified but the invention includes the use of "cards" of any other suitable shape including regular polygonal shapes and irregular novelty or ornamental shapes such as the outline of an animal. Indeed, the card need not be confined to a plane and could, for example, include a curved card or an integral card comprising two planar segments which form an angle.

Figure 2:
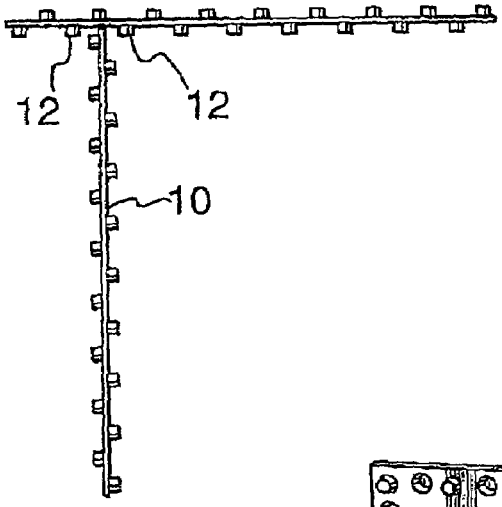
FIG. 2 shows a top view of two building cards in accordance with the first embodiment.

The card 10 is preferably a thin plastic sheet manufactured by moulding or stamping but may be of any suitable material including properly treated heavy paper products. The card 10 is provided on both sides with protrusions 12 extending away from the card 10 and each having a body portion 14. As illustrated in FIG. 2, the thickness of the card 10 is such that it is easily placed between protrusions 12.

The protrusions 12 are proportioned so that an edge 16 of one card may be anchored against one or more protrusions 12 of another card 10 so as to prevent sliding of the card 10 beyond a point defined by a single protrusion 12 or a locus defined by two or more protrusions 12. In this preferred embodiment the protrusions 12 are solid right-angled circular cylinders extending normally from the plane of the card 10. It is also possible, however, to vary the configuration of the protrusions so that they are hollow, tapered, frusto-conical or even an irregular shape. For example, it may be desirable to provide slightly tapering protrusions having a base in the shape of an animal for the purposes of novelty or ornamentation.

Figure 5:
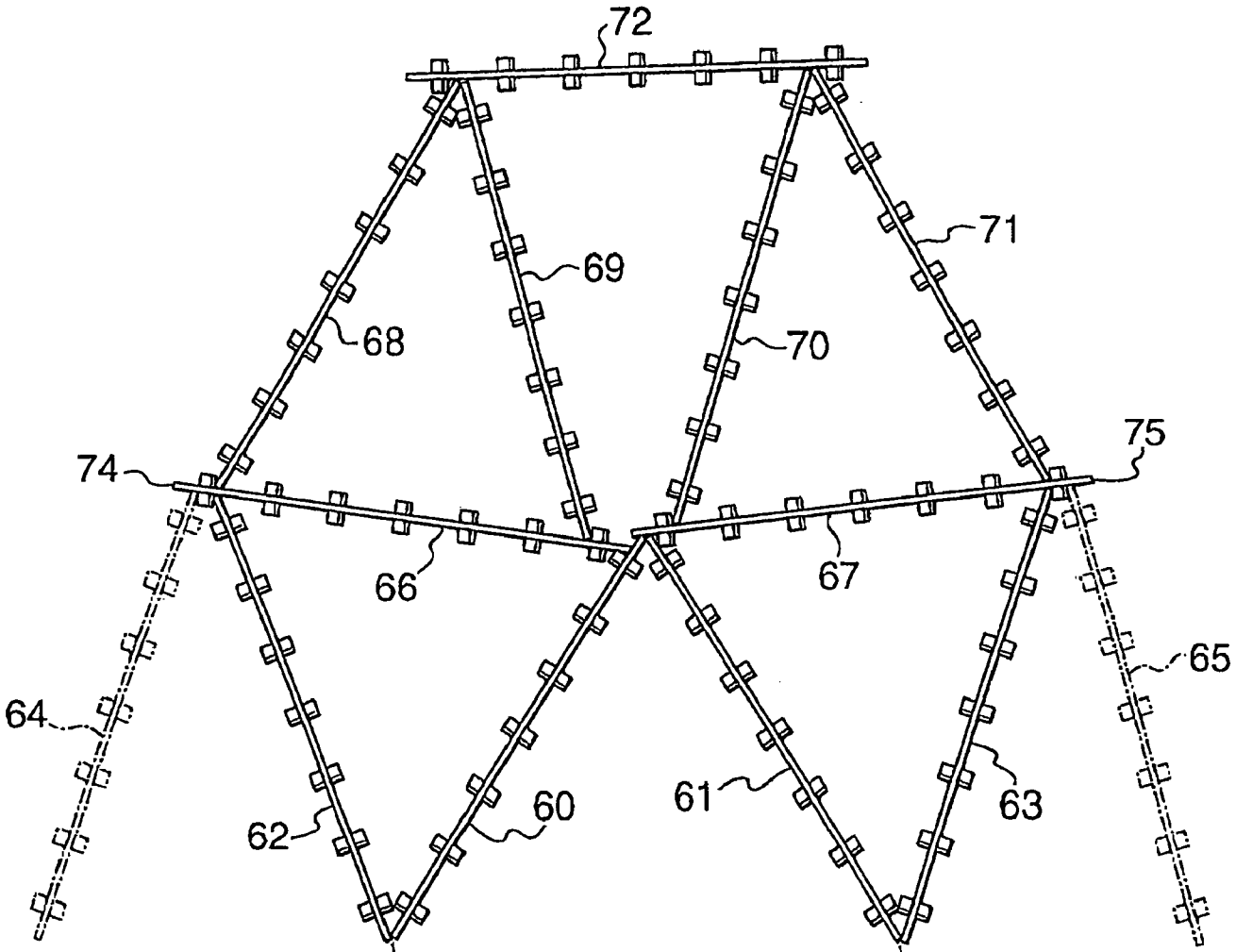
FIG. 5 illustrates a front elevation view of a structure built with cards of the present invention.

The protrusions 12 are uniform in size and shape and are formed in rows 16 along each card 10. The spacing of the protrusions 12 within each row 16 is regular. The corresponding protrusions 12 of each row 16 of a card 10 are formed in columns 18. The rows 16 of protrusions 12 are provided on both surfaces of the card 10 in an alternating fashion as illustrated in FIG. 2 in the edge-on view looking along the 9 rows of each side of card 10. The columns 18 of protrusions 12 may be arranged so that a column 18 is aligned with a corresponding column 18 on the other side of the card 10, for example, as illustrated by FIG. 5 in which the cards 60 to 72 are presented edge-on looking along the 7 pairs of columns of each card. Note that, according to this embodiment, within each column 18 the protrusions 12 are alternately arranged and not opposed. The protrusions 12 may also be arranged in any other configuration consistent with the anchoring function previously described including one where protrusions 12 are provided only on one of the two surfaces of a card 10.

Figure 4:
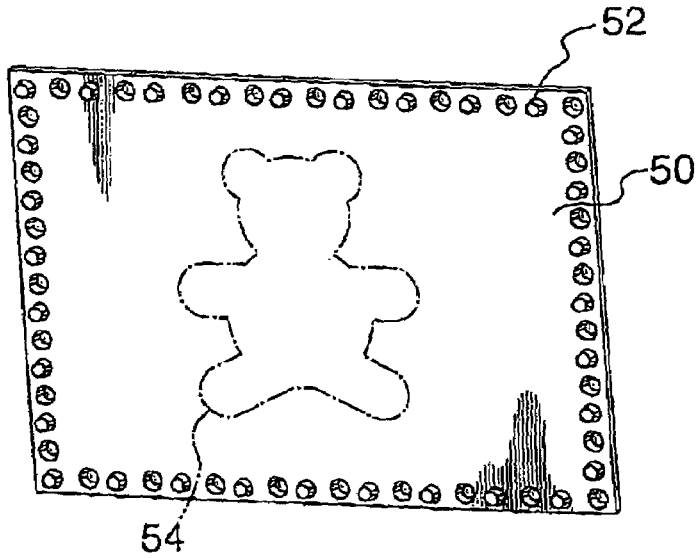
FIG. 4 illustrates a building card according to a second embodiment of the present invention.

It is also possible to have a card in which one or more rows of protrusions follow the perimeter of the card 50. FIG. 4 illustrates a second embodiment in which a single row of hollow frusto-conical protrusions 52 follows the perimeter of the card 50. According to this embodiment the protrusions 52 are provided alternately on each side of the card 50 although other arrangements are possible including one in which each protrusion 52 extends away from both surfaces of the card 50. This is the equivalent of having two rows of back-to-back protrusions 52, each protrusion 52 located opposite a corresponding counterpart positioned on the other surface of the card 50. A central region of at least one surface of the card 50 is free of protrusions 52 and may be either blank or may contain a design 54, as illustrated in FIG. 4, written matter, drawings or any other adornment.

In use a structure may be built directly on a suitable non-slip surface such as a carpet. Alternatively, a number of cards may be laid down one next to another on top of a flat surface such as a table top to form a stable surface upon which to build. An initial structure is then formed on top of the base or a non-slip surface. The builder can then develop the initial structure by adding additional cards to that structure.

It should be noted that, in order to attain the object of permitting the construction of easily disassembled structures, construction using the cards does not depend on the cards being fastened together. Two basic techniques of adding additional cards include (1) balancing an additional card on the existing structure and (2) leaning an additional card against a portion of the existing structure and anchoring an edge of the additional card using either a non-slip surface such as a carpet or the protrusions of another card to prevent undesired sliding thereof.

To balance an additional card, a suitable formation of the existing structure capable of supporting the additional card is identified and the additional card is added to the formation so that it is stably supported. Thus, for instance, referring to FIG. 3, card 28 is balanced on top of cards 22 and 24.

To lean a card, a suitable formation of the existing structure comprising an anchoring portion and a supporting portion is identified. For example the anchoring portion may comprise a plurality of protrusions on a card, which are readily accessible to the builder for placement of the additional card. An edge of the card to be added is placed adjacent the anchoring protrusions in abutting contact with a surface of the card having the anchoring protrusions so that the edge can slide toward the anchoring protrusions. The added card is then leaned against the supporting portion and the edge of the added card is slid along the surface of the card so that the edge comes into abutting contact with the anchoring protrusions so that the added card is stably configured.

Of course variations on this technique exist. For example it may be possible to slide the card into abutting contact with the anchoring protrusions before completing the leaning step of the technique. In illustrating the technique, the case where the anchoring portion consists of a plurality of protrusions located on a single card has been used. The anchoring portion may also comprise a single protrusion on a single card or a plurality of protrusions on more than one card and concomitant modifications to the basic technique should be made in these cases. It is also possible to anchor the added card by placing an edge to be anchored on a suitable non-slip surface such as a carpet instead of the protrusions of another card.

Figure 3:
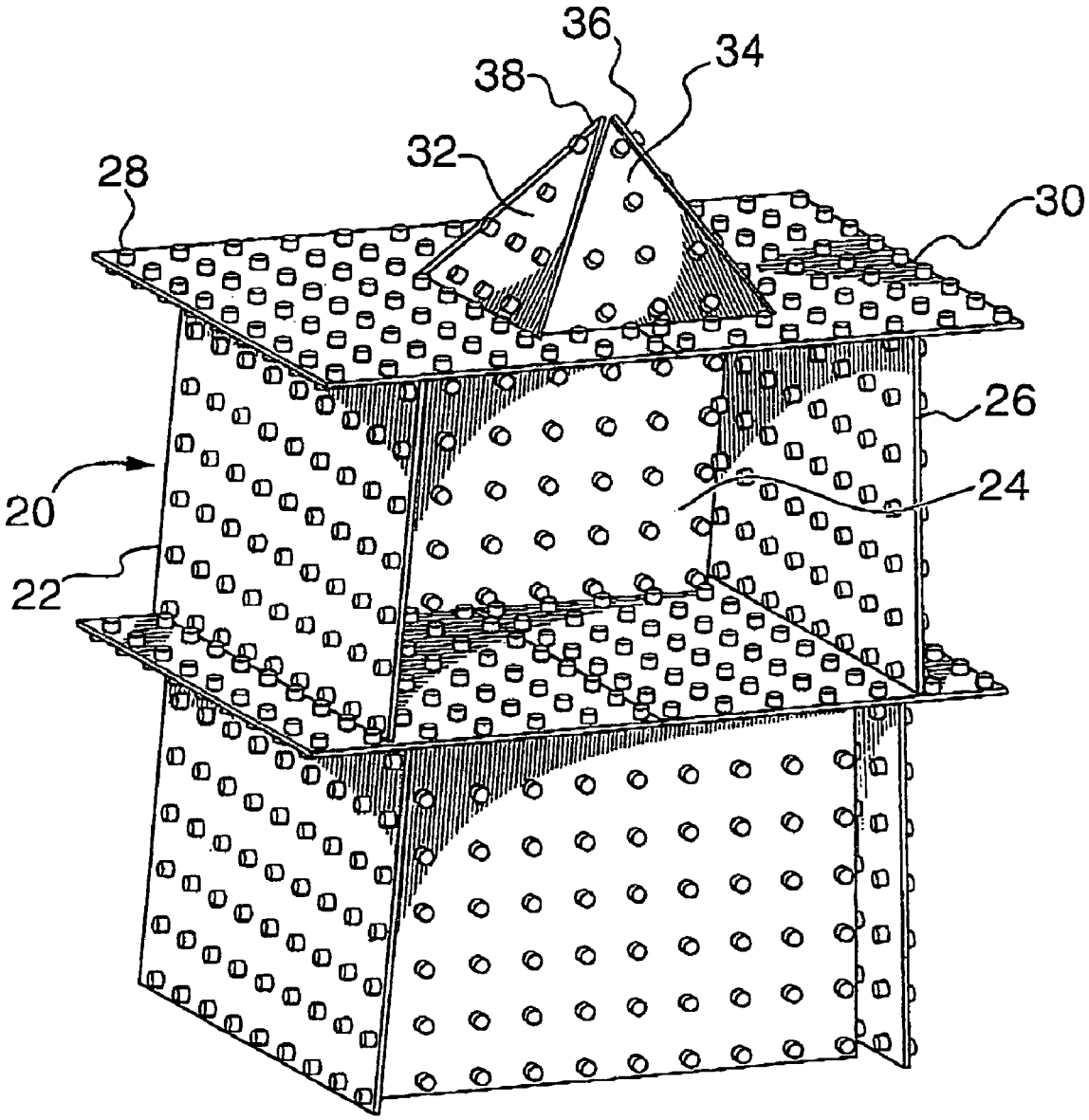
FIG. 3 shows a perspective view of a structure assembled using building cards of the first embodiment.

It may of course be possible to employ other techniques. For example, it is possible to add a multi-card substructure to the existing structure. The multi-card substructure need not itself be stable and the only requirement is that when the substructure is added to the existing structure, the resulting structure is stable. This is illustrated in FIG. 3 in which substructure 20 is added to the existing structure below it. Note that card 22 of substructure 20 is not stable and requires at least card 24 of substructure 20 to support it. Thus while neither of cards 22 or 24 can be singly added to the existing structure, the substructure comprising 22 and 24 (and possibly other cards comprising substructure 20) may be added to form a stable resulting structure. Note that the cards 28 and 30 (and cards 32, 34, 36 and 38 supported thereby) press down on cards 22, 24 and 26 thereby further stabilizing that combination of cards. Note that triangular cards 32, 34, 36 and 38 illustrate a basic variation in the shape of the cards. Of course it is possible to include other shapes in a single set or to have various sets offering different combinations of shaped cards.

Interesting structures can be made using cards according to the present invention which are not possible with other cards such as ordinary playing cards. FIG. 5 illustrates a structure which can be built using cards in accordance with the first embodiment or in the alternative, cards which are variations thereof such as cards having frusto-conical protrusions. Note that portions of the structure 74, 76 extend beyond the base (defined by 77, 78). It would be difficult if not impossible to conceive of how such a structure could be built using, for example, ordinary playing cards.

The structure can be accomplished using techniques similar to those previously described in which cards are leaned or balanced. Note, however, that in order to add cards 66 and 67 to the supporting cards (60, 61, 62, 63) below, temporary cards 64 and 65 are used as illustrated using broken lines. The addition of cards such as 68 to 72 press down on cards 66 and 67 thereby adding to its stability. At a suitable opportunity, temporary cards 64 and 64 can be removed, increasing the elegance of the structure and presenting a challenge to those who are unaware of this technique.

The structures created by the cards are easily disassembled by the application of force (e.g. the sweep of a hand) to the base of the structure. The cards are then ready for reuse or storage as desired.

I claim:

1. A set of elements for building easily disassembled and collapsible structures, each element comprising:

a flat structure a having a front and a rear surface and at least one edge defining a perimeter common to the two surfaces; and a plurality of protrusions on at least one of the surfaces, each protrusion having a body portion extending away from the element;

wherein the body portions of one or more protrusions, when in abutting contact with an edge of another element, anchor the other element by preventing the edge of the other element from sliding beyond the point or locus defined by said one or more protrusions;

whereby structures are assembled by leaning a first element against a second element and anchoring the first element against sliding by one of placing an edge of the first element in abutting contact with at least one protrusion of a third element and anchoring the edge by placing it on a suitable non-slip surface and balancing an element on top of one or more other elements;

at least one of the elements comprising a rectangular card having planar front and rear surfaces and four linear edges, said at least one element being provided with solid protrusions on both surfaces, the body portion of each protrusion being tapered inwardly as it extends away from the front and rear surfaces of the element, and the protrusions being arranged in linear groups and regularly spaced to form rows of substantially uniform shape and size alternately placed on the two surfaces thereof and the corresponding protrusions of each row being linearly arranged to form columns.

2. A set of elements for building easily disassembled and collapsible structures, each element comprising:

a flat structure a having a front and a rear surface and at least one edge defining a perimeter common to the two surfaces; and a plurality of protrusions on at least one of the surfaces, each protrusion having a body portion extending away from the element;

wherein the body portions of one or more protrusions, when in abutting contact with an edge of another element, anchor the other element by preventing the edge of the other element from sliding beyond the point or locus defined by said one or more protrusions;

whereby structures are assembled by leaning a first element against a second element and anchoring the first element against sliding by one of placing an edge of the first element in abutting contact with at least one protrusion of a third element and anchoring the edge by placing it on a suitable non-slip surface and balancing an element on top of one or more other elements;

at least one of the elements comprising a rectangular card having planar front and rear surfaces and four linear edges, the surfaces each having a free region devoid of protrusions centrally located on both surfaces of the at least one element and ornamented by a design element comprising images, said at least one element being provided with solid protrusions, the body portion of each protrusion extending away from the surface of the element, and the protrusions being arranged along arranged adjacent said linear edges on both surfaces of the element.

* * * * *